US005137337A

United States Patent [19]

Seppänen et al.

[11] Patent Number: 5,137,337

[45] Date of Patent: Aug. 11, 1992

[54] METHOD FOR WORKING STEEPLY DIPPING VEIN ORES WITH VERTICALLY DOWNWARDS PROPAGATING PILLARS

[75] Inventors: Pentti Seppänen, Kontiolahti, Finland; Lars-Erik Aaro, Kiruna, Sweden; David R. Lindqvist, Kiruna, Sweden; Karl E. Marttala, Kiruna, Sweden; Nils E. Edeblom, Svappavaara, Sweden

[73] Assignee: Outokumpu Oy, Helsinki, Finland

[21] Appl. No.: 692,485

[22] Filed: Apr. 29, 1991

[30] Foreign Application Priority Data

Apr. 30, 1990 [SE] Sweden ..... 9001553

[51] Int. Cl.[5] ..... F21C 41/00

[52] U.S. Cl. ..... 299/11; 299/19

[58] Field of Search ..... 299/10, 11, 19

[56] References Cited

FOREIGN PATENT DOCUMENTS

| | | | |
|---|---|---|---|
| 160700 | 2/1984 | Fed. Rep. of Germany | 299/11 |
| 308197 | 8/1971 | U.S.S.R. | 299/11 |
| 1162978 | 6/1985 | U.S.S.R. | 299/11 |
| 1270337 | 11/1986 | U.S.S.R. | 299/11 |
| 1317133 | 6/1987 | U.S.S.R. | 299/11 |

*Primary Examiner*—David J. Bagnell

*Attorney, Agent, or Firm*—Brooks Haidt Haffner & Delahunty

[57] ABSTRACT

The invention relates to a cut-and fill method of a mine, where the working is done by pillar working, which propagates vertically downwards. The working is done by placing the stope and the pillars interlaced with each other when propagating downwards. The pillars are made by the hardening fill-method and likewise, at the bottom of the excavated stope, in the lower corners, a bed of hardening fill is made.

3 Claims, 1 Drawing Sheet

Fig. 2 (A-A)
Fig. 3 (B-B)
I
II
III
A
B
1
2
3
4
5

METHOD FOR WORKING STEEPLY DIPPING VEIN ORES WITH VERTICALLY DOWNWARDS PROPAGATING PILLARS

BACKGROUND OF THE INVENTION

1. Field of the Invention

The invention relates to a cut-and fill method of a mine, where the working is done by pillar working, which propagates vertically downwards, the Working is done by placing the stope and the pillars interlaced with each other when propagating downwards. The pillars are made by the hardening fill-method.

2. Description of Related Art

The working of steeply dipping vein ores often includes expensive operating costs and low capacity. However, because the ore body might be valuable, different working methods have been developed. In these circumstances the vein mining method has been used as well as other cut-and fill methods. In one of these methods, which in a sense is a combined working method, the working is unrestricted in the longitudinal direction of the ore, but above it is left either a horizontal pillar of ore or a pillar made with the hardening fill-method. If the mechanical properties of the rock are poor, the horizontal pillars give insufficient support. This can lead to local collapses, collapses at the working site as well as make selective working impossible. In the case of a really valuable and, in terms of its strength, weak ore, a downward propagating cut and fill method has been used, but this method is very inefficient.

SUMMARY OF THE INVENTION

Now a new method in accordance with this invention has been developed, which is used for working steeply dipping vein ores and uses the hardening fill-method, whose efficiency is as good as the above mentioned vein mining or sublevel stoping, but without their above mentioned disadvantages. In this way the ore body can be fully worked when propagating downwards. In the method according to the invention, the propagating occurs vertically downwards, which makes it unnecessary to immediately make deep shafts, which in turn saves on the starting up costs. According to the method, the vertical pillars of the new stope are worked first and then filled with hardening fill. After this, safe working of the stopes between the hardened pillars is possible, either in two stages or one. The dimensioning however, is dependent on the strength characteristics of the ore as well as of the siderock, of the thickness of the ore vein, of the dip and of the regularity.

The dimensioning of the pillars and the stopes has to be such, that the stopes remain open even after empty loading, which makes it possible to fill the stope and the pillars of the next level. A dimensioning which has been found good in practice, is to make the pillars approximately 12 m wide and the stopes 30–40 m wide. The height of the stope and the pillars is preferably in the order of magnitude of 50 m.

In order to make it possible to open a new stope underneath a filled stope, a bed of hardening fill has to be made in the lower corners of the bottom part of the above lying stope, which prevents either filling from above or a possible cave in (if the filling is not done) from flowing downwards into the space that is being worked.

BRIEF DESCRIPTION OF THE DRAWING

The working method according to the invention is also described by the accompanying drawings, in which FIG. 2 is the section A—A in FIG. 1, and FIG. 3 is the section B—B in FIG. 1.

DESCRIPTION OF THE PREFERRED EMBODIMENT

Figure 1:
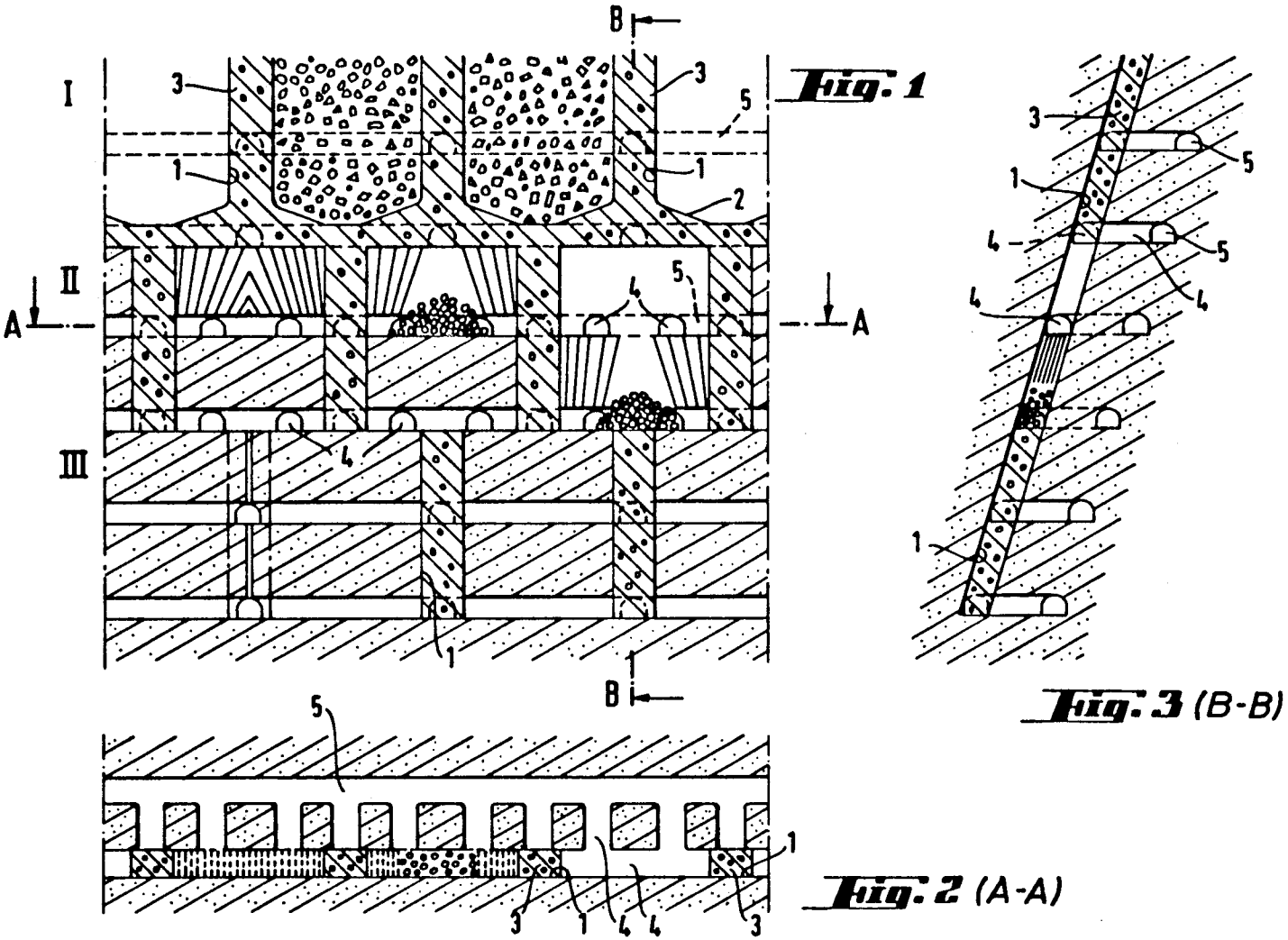
FIG. 1 shows a principle drawing of the way of working according to the invention.

FIG. 1 shows a principle drawing of a working that has proceeded to the third level. The working of the first level (I) is already completed, and as can be seen from the figure, the pillars 1 have been made of hardening fill, and a bed 2 of hardening fill has been made in the bottom part of the stop in its lower corners. At this stage the pillars of the second level (II) are also worked. Following this, stope 3 can at least partially be filled with dead rock (in the figure it has been completely filled). In the schematic drawing, working is preformed in two stages and the worked material is transported through loading openings 4 in the pillars to an inclined tunnel 5 in the side rock. In FIG. 1 on the second level, the upper part of the rightmost stope has been completely worked and the lower part has been partially worked. In the middle and the leftmost stope, the lower part has been completely worked and the upper part is either partially worked or completely unworked. When the lower part of level II has been worked, the pillars of level III can be worked and filled with hardening fill. As can be seen from the drawings, it is preferably to make the pillars in different places on different levels, which makes propagating downwards safe at all times.

The advantages of the method according to the invention compared to methods in use now are at least the following:

A cave of the roof rock in the area of the ore body can be stopped, i.e. local stability is under control.

The stopes can be kept open during the whole working process, which guarantees selective working. In conjunction with the method, a wire bolting can be used as an additional support method, and therefore the size of the stope can be kept large enough to be efficient.

The dilution of the stope with dead rock can be controlled and it decreases, which leads to a corresponding increase in the valuable ore content of the worked ore. The average content can rise by up to 0.5%.

The decrease in the dead rock dilution also decreases the costs of the ore mill and lessens the load on the waste area.

The dead rock derived from the preparing work can be placed in nearby stopes, which have been emptied of ore, thus decreasing the handling costs of the dead rock considerably. The dead rock can also be used as a main ingredient in the hardening fill.

The ore can be worked systematically when propagating downwards and there is no need to leave any horizontal ore pillars. This means that the downwards-excavating speed of the mine decreases.

By systematic controlled use of hardening fill a less risky production can be achieved and this way a more planned use of the mine can be achieved. As a result of this, there is e.g. no more need for emergency work and the high cost involved with it.

The new method requires that the general preparing work is done one level below the working level, but through this it is possible to acquire, early enough, the necessary information that the planning of the excavation demands, and expensive faulty decisions, due to lack of geological information, become fewer.

The rock pressure, which usually increases when propagating downwards, can be kept under control due to the filling of the mine, which is done after the working.

We claim:

1. A method for working steeply dipping vein ores by downwardly propagating pillar working, comprising making pillars of hardening fill as working progresses, including making a bed of hardening fill in lower corners of a first stope and then opening a second stope below said first stope.

2. The method of claim 1 and including propagating downwards while placing pillars and stopes interleaved with each other.

3. The method of claim 2 and including filling each stope with dead rock after said step of making a bed of hardening fill at lower corners of the stope.

* * * * *

UNITED STATES PATENT AND TRADEMARK OFFICE

CERTIFICATE OF CORRECTION

PATENT NO. : 5,137,337

DATED : August 11, 1992

INVENTOR(S) : Pentti Seppanen et al

It is certified that error appears in the above-identified patent and that said Letters Patent is hereby corrected as shown below:

Column 1, line 10, "downwards, the Working" should read:

--downwards. The working--.

Column 2, line 32, "it is preferably to" should read

--it is preferable to--.

Signed and Sealed this

Seventh Day of September, 1993

Bruce Lehman

*Attest:*

BRUCE LEHMAN

*Attesting Officer*

*Commissioner of Patents and Trademarks*